US005789127A

United States Patent [19]

Yamaguchi et al.

[11] Patent Number: 5,789,127

[45] Date of Patent: *Aug. 4, 1998

[54] ELECTROPHOTOGRAPHIC PHOTORECEPTOR

[75] Inventors: Yasuhiro Yamaguchi; Yasuo Sakaguchi, both of Minami Ashigara, Japan

[73] Assignee: Fuji Xerox Co., Ltd., Tokyo, Japan

[ * ] Notice: The term of this patent shall not extend beyond the expiration date of Pat. No. 5,688,621.

[21] Appl. No.: 600,003

[22] Filed: Feb. 14, 1996

[30] Foreign Application Priority Data

Feb. 14, 1995 [JP] Japan ..... 7-047953

[51] Int. Cl.[6] ..... G03G 5/14

[52] U.S. Cl. ..... 430/64; 430/60

[58] Field of Search ..... 430/64, 62, 61, 430/60

[56] References Cited

U.S. PATENT DOCUMENTS

| | | | |
|---|---|---|---|
| 5,091,278 | 2/1992 | Teuscher et al. | 430/64 |
| 5,443,934 | 8/1995 | Suzuki et al. | 430/64 |

FOREIGN PATENT DOCUMENTS

| | | | |
|---|---|---|---|
| 63-316058 | 12/1988 | Japan . | |
| 2-59767 | 2/1990 | Japan . | |
| 3-66663 | 10/1991 | Japan . | |
| 4-124673 | 4/1992 | Japan . | |
| 6-175762 | 6/1992 | Japan | 430/64 |

OTHER PUBLICATIONS

Translation of JP 63-316058, Dec. 1988.

*Primary Examiner*—Christopher D. Rodee
*Attorney, Agent, or Firm*—Oliff & Berridge, PLC

[57] ABSTRACT

A novel electrophotographic photoreceptor comprising an electrically-conductive substrate having provided thereon an undercoat layer and a photoconductive layer in thin order, wherein the undercoat layer is formed by using a high molecular weight compound having an alkoxysilyl group; a high molecular weight compound having an alkoxysilyl group, and an organic metal compound; or a high molecular weight compound having an alkoxysilyl group, an organic metal compound and a silane coupling agent. As the organic metal compound there may be preferably used at least one selected from the group consisting of an organic zirconium compound and an organic titanium compound.

6 Claims, 1 Drawing Sheet

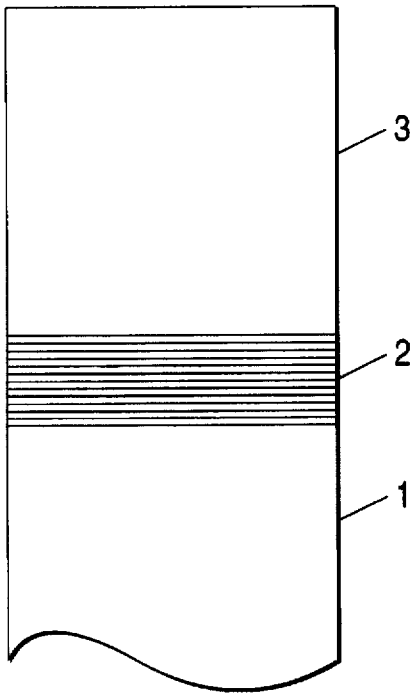
3
2
1

ELECTROPHOTOGRAPHIC PHOTORECEPTOR

FIELD OF THE INVENTION

The present invention relates to an electrophotographic photoreceptor comprising an electrically-conductive substrate, an undercoat layer, and a photoconductive layer. More particularly, the present invention relates to an electrophotographic photoreceptor comprising an undercoat layer formed by using a specific material.

BACKGROUND OF THE INVENTION

An electrophotographic photoreceptor adapted for analog copying machines, digital copying machines, laser printers, LED printers, facsimile machines, etc., which employ electrophotography, is disadvantageous in that if it comprises a photoconductive layer directly formed on an electrically-conductive substrate, it is liable to greater dark decay that leads to deterioration of chargeability or of stability of electrical properties upon repeated use. Further, this type of electrophotographic photoreceptor is disadvantageous in that if the electrophotographic photoreceptor has an insufficient adhesion between the electrically-conductive substrate and the photoconductive layer, the photoconductive layer could peel off, and in that the preparation of the electrophotographic photoreceptor is liable to the occurrence of coating defects such as repellency and peaking during the application of the photoconductive layer to the surface of the substrate. Moreover, if the electrically-conductive substrate is chemically, physically or mechanically heterogeneous, the electrophotographic photoreceptor is liable to local injection of electric charge from the substrate into the photoconductive layer or electrical destruction, resulting in image defects such as black dots and blank areas. An electrophotographic photoreceptor adapted for machines employing a coherent light source such as digital copying machines and laser printers comprises an electrically-conductive substrate roughened on the surface thereof to inhibit the occurrence of fringed image defects caused by interference. Such an electrophotographic photoreceptor is more liable to the foregoing problems.

An approach which has heretofore been practiced to solve these problems is to provide an undercoat layer interposed between the electrically-conductive substrate and the photoconductive layer. As the materials for use in the formation of an undercoat layer, there have been studied thermoplastic general-purpose resins such as polyvinyl acetate, polyvinyl alcohol, polyvinyl butyral, polyvinyl formal, polyvinyl methyl ether, polyamide, casein, gelatin and nitrocellulose and thermosetting general-purpose resins such as epoxy resin, melamine resin, phenol resin and urethane resin.

However, the formation of an undercoat layer by using these general-purpose resins is disadvantageous in that if the thickness of the undercoat layer is increased to exert sufficiently its effects on chargeability, coating defects and image defects, it results in the decrease in sensitivity and the increase in residual potential.

In order to overcome the problems such as residual potential rise caused by the increase of the thickness of the undercoat layer, an attempt has been made to control the resistivity of the undercoat layer by dispersing a particulate organic electrically-conductive material, a particulate inorganic electrically-conductive material, a particulate organic semiconducting material or a particulate inorganic semiconductive material in the foregoing resin. However, this approach cannot solve the problems such as defects caused by maldispersion of particles.

On the other hand, as disclosed in JP-B-3-66663 (The term "JP-B" as used herein means an "examined Japanese patent publication"), it is known that the use of an undercoat layer formed by a sol-gel process using an organic metal compound as a main component makes it possible to inhibit the occurrence of coating defects and image defects without causing any sensitivity decrease and residual potential rise. However, in the case where a cured film is prepared from an organic metal compound by a sol-gel process, the upper limit of the thickness of the resulting undercoat layer which is homogeneous is about 0.3 μm. If the thickness of the resulting undercoat layer exceeds 0.3 μm, defects such as crack can occur. In the case the foregoing photoreceptor for laser printers comprises an electrically-conductive substrate which has been roughened on the surface thereof, the undercoat layer having a thickness as thin as about 0.3 μm is not thick enough to cover up the roughened surface of the substrate and thus cannot fully exert its effect. Further, when a cheap electrically-conductive substrate is used, defects such as peaking on the surface of the substrate are unavoidable. In this respect, an undercoat layer which is thick enough to cover up the roughened surface of the substrate is desired. In order to cope with these problems, JP-A-2-59767 (The term "JP-A" as used herein means an "unexamined published Japanese patent application") and JP-A4-124673 propose an approach which comprises the incorporation of a general-purpose resin compatible with an organic metal compound, such as polyvinyl butyral, to provide a thicker undercoat layer. However, this approach has the following disadvantages:

(1) Since the general-purpose resins which can form a homogeneous composite film that doesn't undergo phase separation from an organic metal compound are limited, the degree of freedom of selection of resin materials is low.

(2) An organic metal compound and a general-purpose resin which can form a homogeneous composite film with the organic compound undergo reaction with each other or agglomeration also in the coating solution to cause the gelation or precipitation of the coating solution. This problem becomes more remarkable when the resin content or the concentration of the resin in the coating solution is raised to increase the thickness of the undercoat layer.

(3) Since the binding power of the network of metal oxide derived from the organic metal compound with the general-purpose resin in the undercoat layer is not too strong, the undercoat layer is subject to modification under the effect of moisture.

SUMMARY OF THE INVENTION

It is therefore an object of the present invention to provide an electrophotographic photoreceptor comprising an electrically-conductive substrate, an undercoat layer and a photoconductive layer which exhibits a high chargeability and an excellent repetition stability, shows no coating defects and image defects and maintains such a performance over an extended period of time regardless of the surface smoothness and homogeneity of the substrate.

It is another object of the present invention to provide an electrophotographic photoreceptor which exhibits a stable chargeability and a low residual potential under conditions ranging from low temperature and low humidity to high temperature and high humidity.

These and other objects of the present invention will become more apparent from the following detailed description and examples.

The inventors made extensive studies of materials for electrophotographic photoreceptors. As a result, it was found that the incorporation of a high molecular weight compound having an alkoxysilyl group which undergoes heat curing to form a silicon-oxygen network in the undercoat layer makes it possible to obtain an excellent electrophotographic photoreceptor and the combined use of the high molecular weight compound and an organic metal compound makes it possible to solve the foregoing problems with the use of an organic metal compound. It was also found that the alkyl group in the foregoing high molecular weight compound having an alkoxysilyl group acts as a protective group inhibiting the reaction of the high molecular weight compound with the organic metal compound in the coating solution to assure the properties of the coating solution over an extended period of time. In the drying process, moisture absorption/heating causes a dealcoholation reaction resulting in the production of active silanol group accompanying the formation of metal-oxygen-silicon bond with the organic metal compound, making it possible to provide a homogeneous and rigid crosslinked cured composite film and hence solve the foregoing problems with the use of the conventional general-purpose resins. Thus, the present invention has been worked out.

The present invention relates to an electrophotographic photoreceptor comprising an undercoat layer and a photoconductive layer provided on an electrically-conductive substrate, characterized in that said undercoat layer is formed from: a high molecular weight compound containing an alkoxysilyl group; a high molecular weight compound containing an alkoxysilyl group, and an organic metal compound; or a high molecular weight compound containing an alkoxysilyl group, an organic metal compound and a silane coupling agent. As the organic metal compound there is preferably used at least one selected from the group consisting of organic zirconium compounds and organic titanium compounds.

BRIEF DESCRIPTION OF THE DRAWING

By way of example and to make the description more clear, reference is made to the accompanying drawing in which:

FIGURE is a typical sectional view of an electrophotographic photoreceptor according to the present invention, wherein the reference numeral 1 indicates an electrically-conductive substrate, the reference numeral 2 indicates an undercoat layer, and the reference numeral 3 indicates a photoconductive layer.

DETAILED DESCRIPTION OF THE INVENTION

The present invention will be further described hereinafter.

FIGURE is a typical sectional view of an electrophotographic photoreceptor according to the present invention. The electrophotographic photoreceptor comprises an electrically-conductive substrate 1 having an undercoat layer 2 provided thereon and a photoconductive layer 3 provided on the undercoat layer 2.

Examples of the material to be used as the electrically-conductive substrate herein include drum or belt made of metal such as aluminum, copper, nickel and stainless steel; resin belt laminated with a metal foil such as aluminum foil; or resin belt having a metal such as aluminum deposited thereon; and metallic or resin drum or belt coated with an electrically-conductive resin or a resin layer having electrically-conductive particles dispersed therein. If necessary, the surface of the foregoing electrically-conductive substrate may be subjected to roughening or oxidation to inhibit the occurrence of interference fringe or to improve the adhesiveness thereof.

The undercoat layer of the present invention should be formed by using a high molecular weight compound having an alkoxysilyl group, preferably in combination with an organic metal compound. If necessary, the undercoat layer of the present invention may be formed by further using a silane coupling agent.

Examples of the foregoing high molecular weight compound having an alkoxysilyl group include a polysiloxane having an alkoxy group in its side chain or at its end, or a polymer having a structural unit represented by the following formula (I)

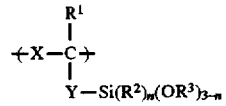

(I)

wherein $R^1$ represents a hydrogen atom, a halogen atom, an alkyl group, an aryl group, an alkoxy group, an aryloxy group or an acyloxy group; $R^2$ and $R^3$ are the same or different, and each represents an alkyl group; X and Y are the same or different, and each represents a divalent hydrocarbon group or a divalent hetero atom-containing hydrocarbon group; and n represents an integer of from 0 to 2.

The foregoing polymer having a structural unit represented by the foregoing formula (I) can be synthesized by the homopolymerization or copolymerization of a silane coupling agent having a polymerizable functional group such as a vinyl group, an acrylic group, a methacrylic group and an epoxy group as at least one of components. Specific examples of the silane coupling agent having a polymerizable functional group include vinyltriethoxysilane, allyltriethoxysilane, (3-acryloxypropyl)trimethoxysilane, (3-methacryloxypropyl) trimethoxysilane, and (3-glycidoxypropyl)trimethoxysilane. As the copolymerizable component, any chemically stable material copolymerizable with the silane coupling agent having a polymerizable functional group may be used. As the high molecular weight compound employable herein, any high molecular weight compound having an alkoxysilyl group as a curing site may be used. Such a high molecular weight compound is not limited to the above-mentioned examples. These high molecular weight compounds may be used singly or in combination.

As the organic metal compound, an organic zirconium compound or organic titanium compound is preferred in particular. Examples of such an organic metal compound include compounds represented by the following formula (II)

$$M(L)_n(X)_{4-n} \quad \text{(II)}$$

wherein M represents zirconium or titanium; L represents a chelate group derived from glycol such as octylene glycol, β-diketone such as acetylacetone, β-ketoester such as acetoacetate and β-ketoalcohol such as diacetone alcohol; X represents a halogen atom, an alkoxy group, an aryloxy group or an acyloxy group; and n represents an integer of from 0 to 4.

Specific examples of such an organic metal compound include trichlorozirconium acetyl acetonate, tripropoxyzirconium octylene glycolate, tributoxyzirconium acetyl acetonate, tributoxyzirconium methyl acetoacetate, tributylzirconium diacetone alcoholate, zirconium tetracarboxylate, tetraisopropoxytitanium, and diisopropoxytitanium bisacetyl acetonate. Further, homooligomerization derivatives or composite oligomerization derivatives of these compounds may be used. These organic metal compounds may be used singly or in combination.

As the silane coupling agent, a compound having an amino group is particularly preferred in light of image quality maintenance. Examples of such a compound include compounds represented by the following general formula (III)

$$R^1R^2N—X—SiR^3(OR^4)_2 \quad (III)$$

wherein $R^1$ and $R^2$ may be the same or different and each represents a hydrogen atom, an alkyl group or an aryl group; X represents a divalent hydrocarbon group or a divalent hetero atom-containing hydrocarbon group; $R^3$ represents an alkyl group, an aryl group or an alkoxy group; and $R^4$ represents an alkyl group.

Specific examples of such a silane coupling agent include aminopropyl trimethoxy silane, N,N-dimethylaminopropyl triethoxy silane, piperidinopropyl trimethoxy silane, N-aminoethyl aminopropyl trimethoxy silane, and (N-phenylaminopropyl) methyl dimethoxy silane. Further, homo- or composite oligomerization derivatives of these compounds, or derivatives produced by composite oligomerization of these compounds with the foregoing organic metal compound may be used. These silane coupling agents may be used singly or in combination.

When an organic metal compound and a silane coupling agent are used in combination, the content of the high molecular weight compound having an alkoxysilyl group in the undercoat layer of the present invention may be arbitrarily determined to a range of 1/20 to 10/1 by weight, preferably 1/10 to 3/1 by weight of the sum of the weight of the organic metal compound and the silane coupling agent. If the content of the high molecular weight compound is less than the above defined range, the resulting film exhibits poor homogeneity if it has an increased thickness. On the contrary, if the content of the high molecular weight compound exceeds the above defined range, it tends to raise the residual potential. However, the tendency in the former case can be relaxed by increasing the molecular weight of the high molecular weight compound. The tendency in the latter case can be relaxed by increasing the content of the alkoxysilyl group in the high molecular weight compound. The amount of the silane coupling agent to be incorporated is preferably not less than 1/1 of the molar amount of the organic metal compound. If the amount of the silane coupling agent exceeds this range, secondary hindrances such as deterioration of film-forming properties can occur.

The thickness of the undercoat layer may be arbitrarily determined to a range of from 0.05 to 15 μm, preferably from 0.5 to 5.0 μm in particular.

The undercoat layer of the present invention can be formed by a process which comprises mixing the foregoing materials in a suitable solvent, applying the mixture to an electrically-conductive substrate by a coating method such as spray coating method and dip coating method, and then drying and curing the coating at a temperature ranging from room temperature to 300° C. Alternatively, a process may be used which comprises previously preparing a powdered curing product of an organic metal compound and a silane coupling agent, dispersing the powder in a solution of a high molecular weight compound, and then applying the dispersion to an electrically-conductive substrate. If necessary, the addition of a catalyst and/or water, or moistening may accelerate the curing reaction.

The undercoat layer thus formed exhibits a high homogeneity and stability and can cover up the surface roughness of the electrically-conductive substrate to inhibit the occurrence of coating defects and image defects. With reference to electrical properties, the undercoat layer of the present invention enhances chargeability, causes no sensitivity deterioration and residual potential rise upon repeated use, and maintains a stable chargeability and a low residual potential under conditions ranging from low temperature and low humidity to high temperature and high humidity. Further, the metal-oxygen-silicon bond can prevent the modification of the film due to moisture or the like, which often occurs. Moreover, the problem of pot life such as gelation of the coating solution, which can occur with the combined use of an organic metal compound and a general-purpose resin, can be solved. The undercoat layer of the present invention can satisfy all the foregoing requirements in the form of single layer. The undercoat layer may be in a multi-layer form so that the various functions can be allotted to the various layers.

The photoconductive layer to be provided on the undercoat layer may be in the form of single layer or laminate. In particular, a negatively-chargeable laminate type photoreceptor may be preferably used. As the charge-generating layer to be incorporated in the laminate type photoreceptor, there may be used one obtained by a process which comprises dispersing a charge-generating material in a solution of a binder resin, applying the dispersion to the undercoat layer by a dip coating method, and then drying the coating, or one obtained by direct film-forming such as vacuum evaporation of a charge-generating material.

Examples of the charge-generating material employable herein include inorganic pigments such as Se, ZnO and CdS, azo pigments such as chlorodian blue, quinone pigments such as anthanthrone and pyrenequinone, quinocyanine pigments, perylene pigments, indigo pigments, bisbenzoimidazole pigments, phthalocyanine pigments such as metal-free phthalocyanine, titanyl phthalocyanine and hydroxy gallium azlenium pigments, squarium pigments, and quinacridone pigments.

Examples of the binder resin include polyvinyl butyral, polyallylate, polycarbonate, polyester, phenoxy resin, vinyl chloride-vinyl acetate copolymer, polyvinyl acetate, acrylic resin, polyacrylamide, polyamide, polyvinyl pyridine, cellulose resin, urethane resin, epoxy resin, polyvinyl alcohol, and polyvinyl pyrrolidone.

The thickness of the charge-generating layer may be arbitrarily determined to a range of from 0.05 to 5 μm, preferably from 0.1 to 1.5 μm.

The charge-transporting layer can be formed by a process which comprises dissolving a binder resin in a solvent, adding a charge-transporting material to the solution, applying the solution to the charge-generating layer by a dip coating method or the like, and then drying the coating.

Examples of the charge-transporting material employable herein include polycyclic aromatic compounds such as anthracene, pyrene and phenanthrene, compounds containing nitrogen-containing heterocyclic group such as indole, carbazole and imidazole, pyrazoline compounds, hydrazone compounds, triphenylmethane compounds, triphenylamine compounds, enamine compounds, and stilbene compounds. As the binder resin, there may be used any film-forming insulating resin. Examples of such a binder resin employable herein polyester, polysulfone, polycarbonate, polymethyl methacrylate, and polyallylate. As the charge-transporting layer, there may be also used a high molecular weight compound which exhibits both film-forming properties and charge-transporting capacity, such as polyvinyl carbazole and silicone polymer.

The thickness of the charge-transporting layer may be arbitrarily determined to a range of from 5 to 50 μm, preferably from 15 to 30 μm.

The present invention will be further described in the following examples, but the present invention should not be construed as being limited thereto.

EXAMPLE 1

| | |
|---|---|
| Methyl methacrylate-butyl acrylate-(3-trimethoxysilylpropyl)methacrylate copolymer (Clearmer-SA-246, available from Sanyo Chemical Industries, Ltd.) | 6 parts by weight |
| Tributoxyzirconium acetyl acetonate (Orgatics ZC540, available from Matsumoto Trading Co., Ltd.) | 20 parts by weight |
| n-Butyl acetate | 25 parts by weight |

A solution of the foregoing components was dip-coated onto a 40 mmϕ×318 mm aluminum pipe which had been honed to roughen the surface thereof, and then dried at a temperature of 165° C. for 10 minutes to form an undercoat layer having a thickness of 1.5 μm.

| | |
|---|---|
| Hydroxygallium phthalocyanine | 5 parts by weight |
| Vinyl chloride-vinyl acetate copolymer (VMCH, available from Union Carbide Co., Ltd.) | 5 parts by weight |
| n-Butyl acetate | 200 parts by weight |

The foregoing components were subjected to dispersion with 1 mmϕ glass beads by means of a sand mill for 2 hours. The dispersion thus obtained was dip-coated onto the foregoing undercoat layer, and then dried at a temperature of 100° C. for 10 minutes to form a charge-generating layer having a thickness of 0.2 μm.

| | |
|---|---|
| Chlorobenzene | 8 parts by weight |
| Compound of the following formula (1) | 1 part by weight |
| Compound of the following formula (2) (PC-Z, available from Mitsubishi Gas Chemical Co., Inc.; viscosity-average molecular weight: 39,000) | 1 part by weight |

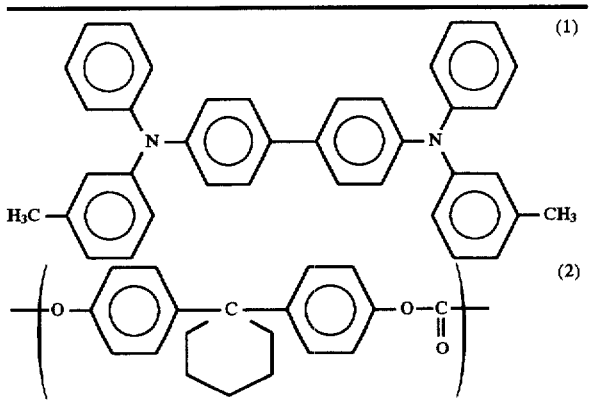

A solution of the foregoing components was dip-coated onto the foregoing charge-generating layer, and then dried at a temperature of 135° C. for 1 hour to form a charge-transporting layer having a thickness of 25 μm. Thus, an electrophotographic photoreceptor was prepared.

The electrophotographic photoreceptor thus prepared was then evaluated for electrical properties and image properties by means of a remodelled version of a commercially available negatively-chargeable reversal development type laser printer (XP-11, available from Fuji Xerox Co., Ltd.) as an evaluation apparatus. The evaluation of electrical properties was effected by measuring the surface potential of the photoreceptor in the development zone in the evaluation apparatus under conditions of normal temperature and humidity (20° C., 40% RH) and low temperature and humidity (10° C., 10% RH). For the evaluation of surface potential, the potential developed without irradiation of laser beam after charging is defined as VH while the potential developed with irradiation of laser beam at 3.0 $\mu J/cm^2$ is defined as VR. Further, a printed image was outputted by the evaluation apparatus to determine defects on the image. The results are set forth in Table 1.

EXAMPLE 2

An electrophotographic photoreceptor was prepared in the same manner as in Example 1 except that the methyl methacrylate-butyl acrylate-(3-trimethoxysilylpropyl) methacrylate copolymer to be incorporated in the undercoat layer coating solution was replaced by an alkoxysilane-modified acrylurethane resin (Clearmer UA-90, available from Sanyo Chemical Industries, Ltd.). The electrophotographic photoreceptor thus prepared was then evaluated in the same manner as in Example 1.

EXAMPLE 3

An electrophotographic photoreceptor was prepared in the same manner as in Example 1 except that the methyl methacrylate-butyl acrylate-(3-trimethoxysilylpropyl) methacrylate copolymer to be incorporated in the undercoat layer coating solution was replaced by a 5:1:1 copolymer of vinyl chloride, vinyl acetate and vinyl triethoxy silane. The electrophotographic photoreceptor thus prepared was then evaluated in the same manner as in Example 1.

EXAMPLE 4

An electrophotographic photoreceptor was prepared in the same manner as in Example 1 except that tributoxyzirconium acetyl acetonate to be incorporated in the undercoat layer coating solution was replaced by dipropoxytitanium bisacetyl acetonate (Orgatics TC100, available from Matsumoto Trading Co., Ltd.). The electrophotographic photoreceptor thus prepared was then evaluated in the same manner as in Example 1.

EXAMPLE 5

An electrophotographic photoreceptor was prepared in the same manner as in Example 1 except that 2 parts by weight of (3-aminopropyl)triethoxysilane were further added to the undercoat layer coating solution. The electrophotographic photoreceptor thus prepared was then evaluated in the same manner as in Example 1.

EXAMPLE 6

An electrophotographic photoreceptor was prepared in the same manner as in Example 1 except that tributoxyzirconium acetyl acetonate to be incorporated in the undercoat layer coating solution was replaced by toluene. The electrophotographic photoreceptor thus prepared was then evaluated in the same manner as in Example 1.

COMPARATIVE EXAMPLE 1

The procedure of Example 1 was followed except that no undercoat layer was provided on the aluminum pipe. As a result, repellency, peaking, etc. are generated during the application of the charge-generating layer. Thus, the electrophotographic photoreceptor was not worth evaluating.

COMPARATIVE EXAMPLE 2

| | |
|---|---|
| Copolymerized nylon (Alamine CM8000, available from Toray Industries, Inc.) | 10 parts by weight |
| Ethanol | 60 parts by weight |

The procedure of Example 1 was followed except that the compositions of the undercoat layer coating solution were replaced by the foregoing compositions. The electrophotographic photoreceptor thus obtained was then evaluated in the same manner as in Example 1.

COMPARATIVE EXAMPLE 3

The procedure of Example 1 was followed except that the methyl methacrylate-butyl acrylate-(3-trimethoxysilylpropyl)methacrylate copolymer to be incorporated in the undercoat layer coating solution was replaced by a polyvinyl butyral (S-lec BM-S, available from Sekisui Chemical Co., Ltd.). As a result, the undercoat layer coating solution underwent gelation and thus could not form the desired undercoat layer.

COMPARATIVE EXAMPLE 4

The procedure of Example 1 was followed except that the methyl methacrylate-butyl acrylate-(3-trimethoxysilylpropyl)methacrylate copolymer to be incorporated in the undercoat layer coating solution was replaced by a methyl methacrylate-butyl acrylate copolymer. As a result, the undercoat layer thus formed underwent phase separation and thus could not provide a homogeneous film.

The results of Examples 2 to 5 and Comparative Example 2 are set forth in Table 1 with that of Example 1.

TABLE 1

| | Normal temperature and humidity (20° C., 40% RH) | | | Low temperature and humidity (10° C., 10% RH) | | |
|---|---|---|---|---|---|---|
| Example No. | VH(V) | VR(V) | Image defects | VH(V) | VR(V) | Image defects |
| Example 1 | −815 | −30 | None | −825 | −50 | None |
| Example 2 | −820 | −30 | None | −825 | −45 | None |
| Example 3 | −805 | −25 | None | −815 | −45 | None |
| Example 4 | −800 | −20 | None | −805 | −35 | None |
| Example 5 | −820 | −35 | None | −830 | −60 | None |
| Example 6 | −820 | −60 | None | −840 | −75 | None |
| Comparative Example 2 | −825 | −45 | None | −850 | −125 | Black dots* |

(*increased with the number of printed sheets)

As mentioned above, the electrophotographic photoreceptor according to the present invention comprises an undercoat layer having the above mentioned constitution exhibits excellent effects such as high chargeability, low residual potential and stable sensitivity over a wide range of temperature and humidity, that is, from low temperature and low humidity to high temperature and high humidity, without having any coating defects or image defects even if it comprises a substrate having a roughened surface. Further, the electrophotographic photoreceptor can maintain desired electrical properties and image properties upon repeated use and thus exhibit a prolonged photoreceptor life. The present invention is further advantageous in that the undercoat layer coating solution has a sufficiently prolonged pot life and thus can form an undercoat layer with invariably stable properties.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically-conductive substrate having provided thereon an undercoat layer and a photoconductive layer in this order, wherein said undercoat layer is formed by curing a homopolymer having a structural unit represented by formula (I)

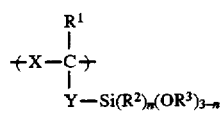

(I)

wherein $R^1$ represents a hydrogen atom, a halogen atom, an alkyl group, an aryl group, an alkoxy group, an aryloxy group or an acyloxy group; $R^2$ and $R^3$ are the same or different, and each represents an alkyl group; X and Y are the same or different, and each represents a divalent hydrocarbon group or a divalent hetero atom-containing hydrocarbon group; and n represents an integer of from 0 to 2.

2. The electrophotographic photoreceptor according to claim 1, wherein said undercoat layer is formed by curing said homopolymer with an organic metal compound.

3. The electrophotographic photoreceptor according to claim 2, wherein said organic metal compound is at least one selected from the group consisting of an organic zirconium compound and an organic titanium compound.

4. The electrophotographic photoreceptor according to claim 2, wherein said organic metal compound is represented by the following formula (II)

$$M(L)_n(X)_{4-n} \quad (II)$$

wherein M represents zirconium or titanium; L represents a chelate group derived from β-diketone; X represents a halogen atom, an alkoxy group, an aryloxy group or an acyloxy group; and n represents an integer of from 0 to 4.

5. The electrophotographic photoreceptor according to claim 2, wherein said undercoat layer is formed by curing said homopolymer with said organic metal compound and a silane coupling agent.

6. The electrophotographic photoreceptor according to claim 5, wherein said silane coupling agent has an amino group.

* * * * *